US011828431B2

(12) United States Patent
Lee

(10) Patent No.: US 11,828,431 B2
(45) Date of Patent: Nov. 28, 2023

(54) LAMP FOR VEHICLE AND VEHICLE INCLUDING THE SAME

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/811,024

(22) Filed: Jul. 6, 2022

(65) Prior Publication Data

US 2023/0088517 A1 Mar. 23, 2023

(30) Foreign Application Priority Data

Sep. 17, 2021 (KR) ..... 10-2021-0124958

(51) Int. Cl.
*F21S 41/26* (2018.01)
*F21S 41/27* (2018.01)
*F21S 41/24* (2018.01)

(52) U.S. Cl.
CPC ..... *F21S 41/27* (2018.01); *F21S 41/24* (2018.01)

(58) Field of Classification Search
CPC ..... F21S 41/27; F21S 41/24; F21S 41/255; F21S 41/43; F21S 41/25; F21S 41/26; F21S 43/236; F21V 5/02; F21V 5/04; F21V 5/043; F21V 5/048; G02B 19/00; G02B 6/0001; G02B 17/08; F21K 9/61
See application file for complete search history.

(56) References Cited

FOREIGN PATENT DOCUMENTS

| | | | | | |
|---|---|---|---|---|---|
| CN | 1523261 | A | * | 8/2004 | ..... F21S 41/143 |
| CN | 105351860 | A | * | 2/2016 | ..... F21S 41/00 |
| CN | 211875908 | U | * | 11/2020 | |
| DE | 102012212557 | A1 | * | 1/2014 | ..... F21S 48/1145 |
| WO | WO-2020045674 | A1 | * | 3/2020 | ..... F21S 41/143 |

OTHER PUBLICATIONS

Search English translation of CN-211875908-U (Year: 2020).*
Search English translation of DE-102012212557-A1 (Year: 2014).*
Search English translation of CN-1523261-A (Year: 2004).*
Search English translation of CN-105351860-A (Year: 2016).*
Search English translation of WO 2020045674 A1 (Year: 2020).*

* cited by examiner

*Primary Examiner* — Omar Rojas Cadima
(74) *Attorney, Agent, or Firm* — DLA PIPER LLP (US)

(57) ABSTRACT

A lamp for a vehicle, the lamp including a light source configured to emit light, and a light guide body provided forward of the light source and configured to allow the light to enter the light guide body, in which the light guide body includes a body portion, the body portion includes a recessed region formed in a lower surface of the body portion and recessed upward, the recessed region includes a first section extending to be inclined upward in a forward direction, and a second section provided forward of the first section and extending forward or downward from the first section, and a material layer configured to reflect or absorb the light is provided on a surface of the second section.

20 Claims, 6 Drawing Sheets

LAMP FOR VEHICLE AND VEHICLE INCLUDING THE SAME

CROSS-REFERENCE TO RELATED APPLICATION

This application claims priority to and the benefit of Korean Patent Application No. 10-2021-0124958 filed in the Korean Intellectual Property Office on Sep. 17, 2021, the entire contents of which are incorporated herein by reference.

TECHNICAL FIELD

The present disclosure relates to a lamp for a vehicle and a vehicle including the same.

BACKGROUND ART

Various types of vehicle lamps, which may be classified based on functions thereof, are mounted in a vehicle. For example, low beam lamps, high beam lamps, daytime running light (DRL) lamps, and the like are mounted on a front side of the vehicle. Among the vehicle lamps, the low beam lamp forms a light distribution pattern having a shape of a cut-off line formed at an upper side thereof.

Meanwhile, in some instances, the low beam lamp includes an inner lens configured to totally reflect light and allow the light to exit forward. In this case, a region having the highest luminous intensity is formed at the periphery of the cut-off line in a low-beam light distribution pattern. To this end, the light is concentrated in a particular region of the inner lens.

However, in the related art, when the light is concentrated in a particular region of the inner lens, the temperature of the particular region of the inner lens excessively increases. For this reason, there is a problem in that the inner lens is deformed and damaged, which makes it impossible to appropriately exhibit a function of the low beam lamp.

SUMMARY

The present disclosure has been made in an effort to solve a problem that light is concentrated in a particular region of an inner lens in a lamp for a vehicle having the inner lens, which causes deformation of and damage to the inner lens.

An aspect of the present disclosure provides a lamp for a vehicle, the lamp including: a light source configured to emit light; and a light guide body provided forward of the light source and configured to allow the light to enter the light guide body, in which the light guide body is made of a material that transmits the light, in which the light guide body includes a body portion configured to define a body of the light guide body, in which the body portion includes a recessed region formed in a lower surface of the body portion and recessed upward, in which the recessed region includes: a first section extending to be inclined upward in a forward direction; and a second section provided forward of the first section and extending forward or downward from the first section, and in which a material layer configured to reflect or absorb the light is provided on a surface of the second section.

The material layer may be provided only in the second section between the first section and the second section.

The first section may be configured to allow light beams, which reach at least a part region of the first section among the light beams emitted from the light source, to be totally reflected in the first section.

The first section may be configured to allow light beams, which reach any region of the first section among the light beams emitted from the light source, to be totally reflected in the first section.

The light guide body may include a light entering portion connected to a rear side of the body portion; and a light exiting portion connected to a front side of the body portion, the light entering portion may have a shape convexly protruding rearward, and the light exiting portion may have a shape convexly protruding forward.

At least a part of the second section may be provided forward of a focal point FO of the light exiting portion.

The focal point FO of the light exiting portion may be spaced apart upward from the second section and disposed within a width of the second section in a forward/rearward direction and a leftward/rightward direction.

The second section may include: a second-first section connected to the first section and extending forward from the first section; and a second-second section connected to the second-first section and extending downward from the second-first section, and the material layer may be provided only in the second-second section of the second section.

The second section may include: a second-first section connected to the first section and extending forward from the first section; and a second-second section connected to the second-first section and extending downward from the second-first section, and the material layer may be provided in each of the second-first section and the second-second section.

The light guide body may satisfy Expression 1 below when a height of the light entering portion in an upward/downward direction is h, a distance from a focal point F1 of the light entering portion to the light entering portion in a leftward/rightward direction is d, and an incident angle of incident light, which enters the light entering portion and reaches the first section, with respect to the first section is θ:

$$\tan(90°-\theta) \geq (h/2d). \qquad \text{Expression 1:}$$

The light entering portion may have a shape symmetric in the upward/downward direction and the leftward/rightward direction.

A direction in which the second-first section extends in a forward/rearward direction may be parallel to an optical axis AO of the light exiting portion.

A direction in which the second-first section extends in a forward/rearward direction may intersect the optical axis AO of the light exiting portion at a predetermined angle.

The second-first section may be inclined upward in the forward direction with respect to the optical axis AO of the light exiting portion.

The second-first section may be inclined downward in the forward direction with respect to the optical axis AO of the light exiting portion.

The second-first section may include a cut-off portion having a stepped shape, and the cut-off portion may include: an upper surface provided at one side based on a leftward/rightward direction; a lower surface provided at the other side based on the leftward/rightward direction and disposed below the upper surface; and an inclined surface configured to connect the upper surface and the lower surface and extending to be inclined.

A height of the light entering portion in an upward/downward direction may be higher than a height of the light exiting portion in the upward/downward direction.

A width of the light entering portion in a leftward/rightward direction may be larger than a width of the light exiting portion in the leftward/rightward direction.

The lamp may further include a collimator provided forward of the light source and configured to allow light emitted from the light source to enter the collimator.

Another aspect of the present disclosure provides a vehicle including: a lamp for a vehicle, in which the lamp for a vehicle includes: a light source configured to emit light; and a light guide body provided forward of the light source and configured to allow the light to enter the light guide body, in which the light guide body is made of a material that transmits the light, in which the light guide body includes a body portion configured to define a body of the light guide body, in which the body portion includes a recessed region provided in a lower surface of the body portion and recessed upward, in which the recessed region includes: a first section extending to be inclined upward in a forward direction; and a second section provided forward of the first section and extending forward or downward from the first section, and in which a material layer configured to reflect or absorb the light is provided on a surface of the second section.

According to the present disclosure, it is possible to solve the problem that light is concentrated in a particular region of the inner lens in the lamp for a vehicle having the inner lens, which causes deformation of and damage to the inner lens.

DETAILED DESCRIPTION

Hereinafter, a lamp for a vehicle and a vehicle according to the present disclosure will be described with reference to the drawings.

Lamp for Vehicle

Figure 1:
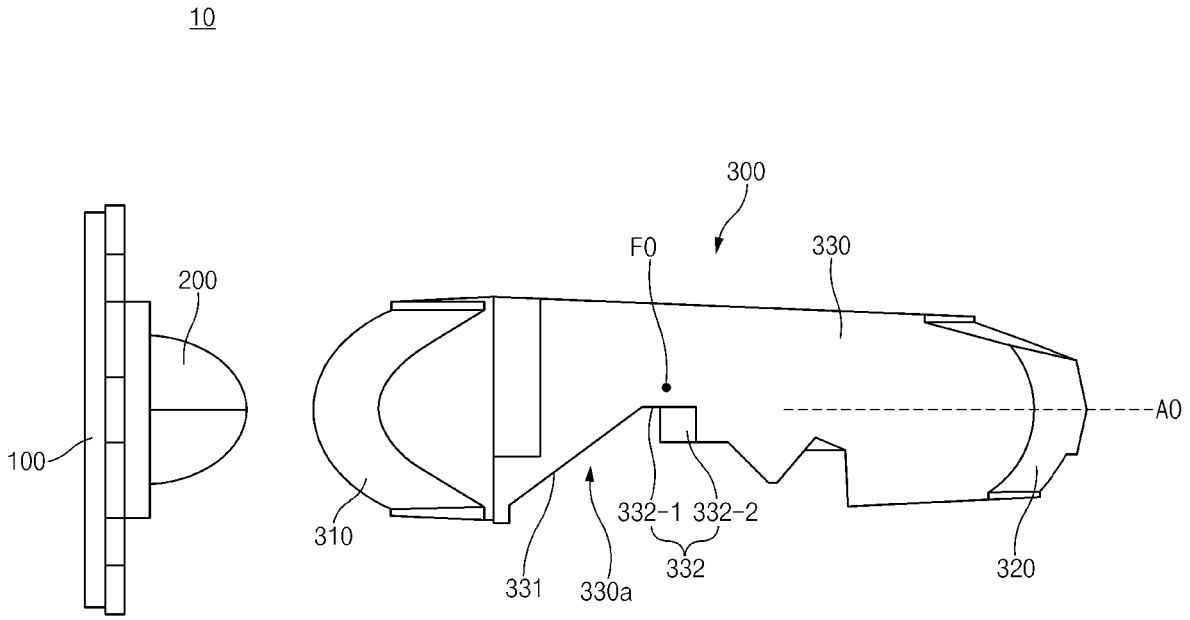
FIG. 1 is a side view illustrating a lamp for a vehicle according to the present disclosure.
Figure 2:
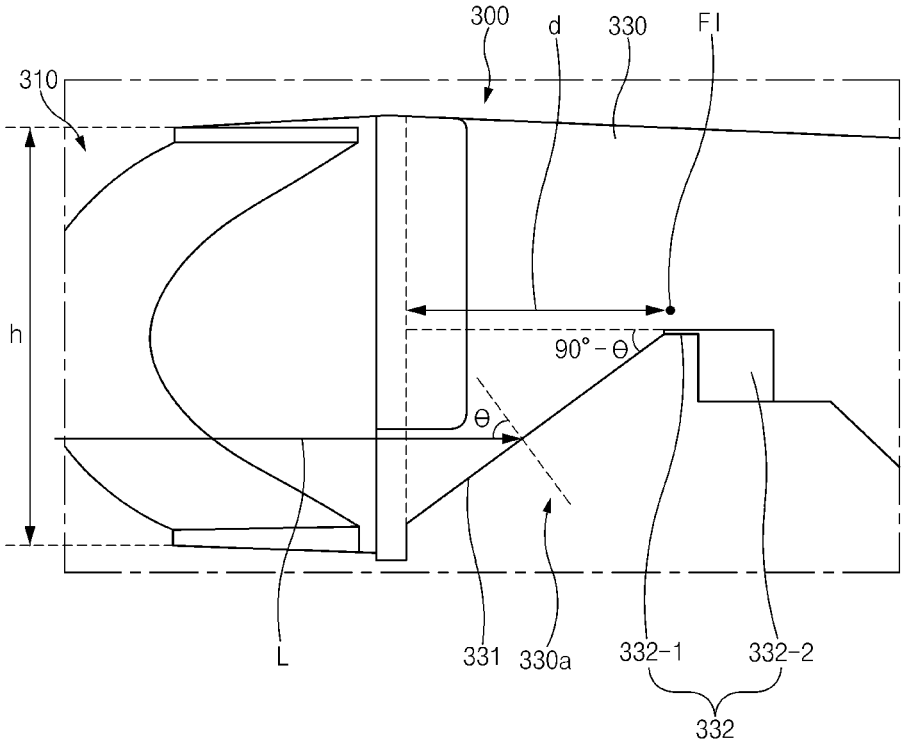
FIG. 2 is an enlarged view illustrating a light entering portion and a body portion of a light guide body of the lamp for a vehicle according to the present disclosure.
Figure 3:
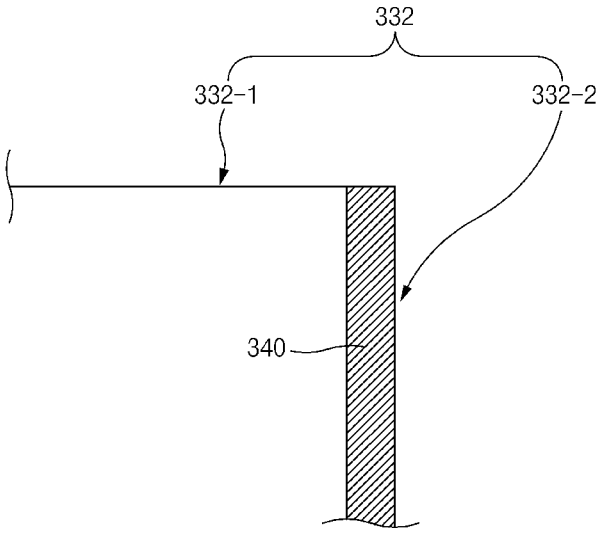
FIG. 3 is a view illustrating an example in which a material layer is formed in a second section of the lamp for a vehicle according to the present disclosure.
Figure 4:
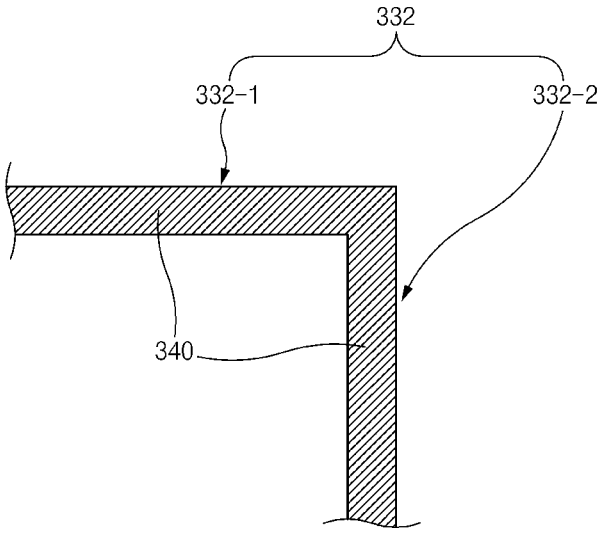
FIG. 4 is a view illustrating another example in which the material layer is formed in the second section of the lamp for a vehicle according to the present disclosure.
Figure 5:
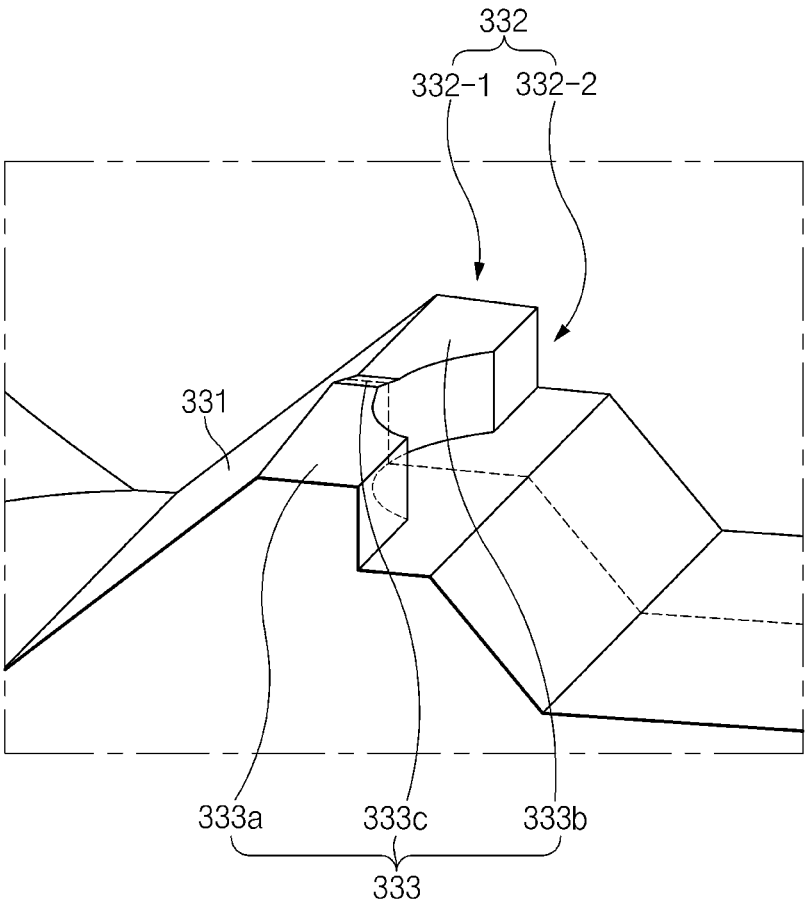
FIG. 5 is an enlarged perspective view illustrating a recessed region of the light guide body of the lamp for a vehicle according to the present disclosure.
Figure 6:
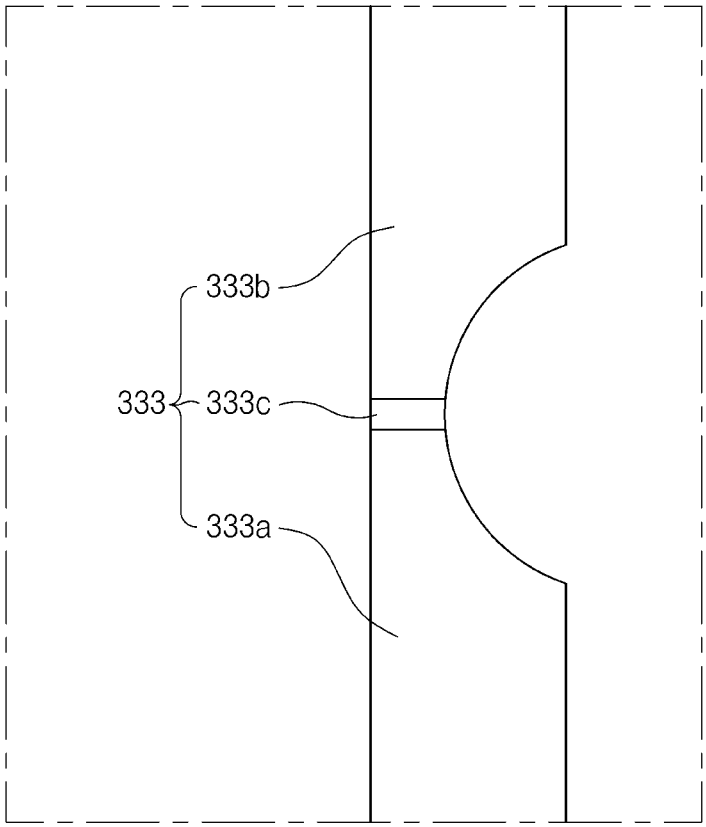
FIG. 6 is an enlarged top plan view illustrating the recessed region of the light guide body of the lamp for a vehicle according to the present disclosure.

FIG. 1 is a side view illustrating a lamp for a vehicle according to the present disclosure, and FIG. 2 is an enlarged view illustrating a light entering portion and a body portion of a light guide body of the lamp for a vehicle according to the present disclosure. FIG. 3 is a view illustrating an example in which a material layer is formed in a second section of the lamp for a vehicle according to the present disclosure, and FIG. 4 is a view illustrating another example in which the material layer is formed in the second section of the lamp for a vehicle according to the present disclosure. In addition, FIG. 5 is an enlarged perspective view illustrating a recessed region of the light guide body of the lamp for a vehicle according to the present disclosure, and FIG. 6 is an enlarged top plan view illustrating the recessed region of the light guide body of the lamp for a vehicle according to the present disclosure.

A lamp 10 for a vehicle (hereinafter, referred to as a 'lamp') according to the present disclosure may be a low beam lamp for forming a low beam pattern.

More specifically, as illustrated in FIG. 1, the lamp 10 according to the present disclosure may include a light source 100 configured to emit light. The light source 100 may be an LED, but the type of light source 100 is not limited thereto.

The lamp 10 may include a collimator 200 disposed forward of the light source 100, and the light emitted from the light source 100 enters the collimator 200. The collimator 200 may be configured to convert the light, emitted from the light source 100, into parallel light and allow the parallel light to exit the collimator 200. Because the optical principle in which the light entering the collimator 200 exits as the parallel light is widely known, the description of the optical principle is replaced with the description of the related art.

Referring to FIG. 1, the lamp 10 according to the present disclosure may further include a light guide body 300 provided forward of the light source 100 and the collimator 200, and the light exiting the collimator 200 enters the light guide body 300.

More specifically, the light, which is emitted from the light source 100 and enters the light guide body 300 through the collimator 200, may propagate forward while being totally reflected in the light guide body 300 and then exit the light guide body 300. As described below, a part of the light having entered the light guide body 300 may propagate forward, whereas another part of the light may be prevented from propagating forward. Therefore, the light exiting the light guide body 300 may form a predetermined beam pattern. The beam pattern may be the low beam pattern as described above.

Meanwhile, the light guide body 300 may be made of a transparent material that transmits light. For example, the light guide body 300 may be made of a plastic material. In this case, the light guide body 300 made of plastic may be advantageous in ease of manufacturing because the light guide body 300 is easily formed. In particular, because the light guide body 300 according to the present disclosure, as described below, has an atypical shape in comparison with an inner lens in the related art, the light guide body 300 made of plastic may be considerably advantageous in ease of manufacturing.

For example, the light guide body 300 may be made of polycarbonate (PC) or polymethyl methacrylate (PMMA). However, on the contrary to the above-mentioned description, the light guide body 300 may of course be made of glass.

Referring to FIG. 1, the light guide body 300 may include: a light entering portion 310 provided at a rear side of the light guide body 300, disposed to face the collimator 200, and configured to allow the light exiting the collimator 200 to enter the light entering portion 310; a light exiting portion 320 provided at a front side of the light guide body 300 and configured to allow the light exiting the light entering portion 310 to enter the light exiting portion 320; and a body portion 330 configured to connect the light entering portion 310 and the light exiting portion 320 and define a body of the light guide body 300. The light entering portion 310, the light exiting portion 320, and the body portion 330 may be integrated. The configuration in which the light entering portion 310, the light exiting portion 320, and the body portion 330 are integrated may mean that the light entering portion 310, the light exiting portion 320, and the body portion 330 are made of one material and thus coupled to one another indivisibly. Therefore, the light entering portion 310 may be connected to the rear side of the body portion 330, and the light exiting portion 320 may be connected to the front side of the body portion 330.

Meanwhile, as illustrated in FIG. 1, the light entering portion 310 may have a shape protruding convexly rearward, and the light exiting portion 320 may have a shape protruding convexly forward. Therefore, a focal point F1 of the light entering portion 310 may be positioned forward of the light entering portion 310, and a focal point FO of the light exiting portion 320 may be positioned rearward of the light exiting portion 320. More specifically, the focal point F1 of the light entering portion 310 and the focal point FO of the light exiting portion 320 may be positioned in the body portion 330.

In addition, the light entering portion 310, the light exiting portion 320, and the body portion 330 may be distinguished based on the shape of the light guide body 300. As described above, the light entering portion 310 may have a shape protruding convexly rearward, and the light exiting portion 320 may have a shape protruding convexly forward. In addition, upper and lower surfaces of the body portion 330 may each have a planar shape. Therefore, a boundary between the light entering portion 310 and the body portion 330 may be defined at a point at which a curved surface of the light entering portion 310 meets a flat surface of the body portion 330. A boundary between the light exiting portion 320 and the body portion 330 may be defined at a point at which a curved surface of the light exiting portion 320 meets a flat surface of the body portion 330.

As described above, the lamp 10 according to the present disclosure may be a lamp for forming a low beam pattern. To this end, according to the present disclosure, the body portion 330 of the light guide body 300 may include a recessed region 330*a* provided in a lower surface of the body portion 330 and having a shape recessed upward. Therefore, the light beams, which reach the recessed region 330*a* among the light beams entering the light guide body 300 after being emitted from the light source 100, may be reflected in the recessed region 330*a* and prevented from propagating forward. Therefore, a low beam pattern having a cut-off line may be formed. More specifically, the recessed region 330*a* may further include a cut-off portion having a shape corresponding to the cut-off line of the low beam pattern. The cut-off portion will be described below in detail.

As illustrated in FIGS. 1 and 2, the recessed region 330*a* may include a first section 331 extending to be inclined upward in a forward direction, and a second section 332 provided forward of the first section 331 and extending forward or downward from the first section 331. For example, the first section 331 may have a planar shape extending to be inclined upward in the forward direction.

In this case, referring to FIGS. 3 and 4, a material layer 340 may be provided on a surface of the second section 332 and reflect or absorb the light emitted from the light source 100. Therefore, the light beams, which reach the second section 332 among the light beams entering the light guide body 300, may be reflected by the material layer 340 and then propagate upward. Therefore, the beam pattern having a predetermined shape may be formed at a location in front of the lamp 10. The material layer 340 provided in the second section 332 may serve to prevent the light beams from propagating forward. More particularly, according to the present disclosure, the material layer 340 may be provided only in the second section 332 between the first section 331 and the second section 332.

Because the material layer 340 is provided only in the second section 332 as described above, the material layer might not be provided on a surface of the first section 331. In this case, because the light guide body 300 may be made of a transparent material as described above, the surface of the first section 331 may be in a transparent state.

However, according to the present disclosure, because the light emitted from the light source 100 is reflected in the first section 331, the light emitted from the light source 100 may be prevented from propagating forward even though no material layer is provided on the surface of the first section 331. More specifically, the light having reached the first section 331 may be reflected totally and thus prevented from propagating forward.

As described above, the focal point F1 of the light entering portion 310 and the focal point FO of the light exiting portion 320 may be positioned in the body portion 330. In particular, according to the present disclosure, the focal point F1 of the light entering portion 310 and the focal point FO of the light exiting portion 320 may be disposed to be adjacent to or coincident with each other in order to maximize the light concentration efficiency implemented by the light guide body 300. Therefore, a large amount of light, which enters the light guide body 300 through the light entering portion 310, is collected on the focal point F1 of the light entering portion 310, exits the focal point FO of the light exiting portion 320, and passes through the light exiting portion 320, thereby forming the beam pattern.

In this case, to meet the regulations in respect to the luminous intensity required for the low beam pattern, a center of the cut-off line of the low beam pattern needs to have high luminous intensity. To this end, the focal point F1 of the light entering portion 310 and the focal point FO of the light exiting portion 320 need to be provided in the vicinity of the recessed region 330*a* in which the cut-off portion is provided. Therefore, the light emitted from the light source 100 is mainly collected in the vicinity of the recessed region 330*a*.

In this case, in a case in which the material layer 340 is provided in the first section 331 in the recessed region 330*a* that the light reaches first, the material layer 340 absorbs the light, such that a temperature of the first section 331 increases. This may cause a problem of deformation of and damage to the recessed region 330*a* including the first section 331.

However, according to the present disclosure, because the material layer 340 configured to absorb or reflect the light is provided in the second section 332, instead of the first section 331, it is possible to solve the problem of deformation and damage. That is, according to the present disclosure, among the light beams that are emitted from the light source 100 and reach the first section 331, a large number of light beams are reflected upward from the first section 331 while being totally reflected primarily, and the remaining light beams pass through the first section 331 by means of light transmission of the first section 331. The light passing through the first section 331 may reach the second section 332. In this case, the material layer 340 provided in the second section 332 may prevent the light from propagating forward. That is, according to the present disclosure, the light beams, of which the forward propagation needs to be blocked to form the cut-off line of the low beam pattern among the light beams emitted from the light source 100, are blocked primarily by being totally reflected in the first section 331, and the remaining light beams are blocked secondarily by the material layer 340 in the second section 332. Therefore, in comparison with the case in which the material layer 340 is provided in the first section 331, the light is concentratedly absorbed in the first section 331, which makes it possible to prevent the problem of deformation of or damage to the recessed region 330*a*.

Based on the above-mentioned description, according to the present disclosure, the first section 331 needs to be configured to allow the light beams, which reach at least a part region of the first section 331 among the light beams emitted from the light source 100, to be totally reflected in the first section 331.

More particularly, the first section 331 needs to be configured to allow the light beams, which reach any region of the first section 331 among the light beams emitted from the light source 100, to be totally reflected in the first section 331. However, the configuration in which the light beams reaching any region of the first section 331 are totally reflected in the first section 331 does not mean that all the light beams reaching the first section 331 are totally reflected and there is absolutely no light beam that passes through the first section 331. The configuration in which the light beams reaching any region of the first section 331 are totally reflected in the first section 331 may mean that at least some of the light beams are totally reflected in the first section 331 and thus prevented from propagating forward even though the light beams emitted from the light source 100 reach any region of the first section 331.

Referring to FIGS. 1 and 2, in the lamp 10 according to the present disclosure, at least a part of the second section 332 may be positioned forward of the focal point FO of the light exiting portion 320. This may be to prevent the light from concentratedly reaching the second section 332. More specifically, the focal point FO of the light exiting portion 320 may be spaced apart upward from the second section 332 and provided within a width of the second section 332 based on a forward/rearward direction and a leftward/rightward direction.

Meanwhile, the second section 332 may be divided into a plurality of sub-sections. More specifically, the second section 332 may include a second-first section 332-1 connected to the first section 331 and extending forward from the first section 331, and a second-second section 332-2 connected to the second-first section 332-1 and extending downward from the second-first section 332-1. Therefore, the second-second section 332-2 may face the first section 331 with the second-first section 332-1 interposed therebetween.

Meanwhile, as illustrated in FIG. 3, according to an example of the present disclosure, the material layer 340 may be provided only in the second-second section 332-2 of the second section 332. The light beams, which cannot be totally reflected among the light beams reaching the first section 331, propagate forward while passing through the first section 331, and propagates to the second-second section 332-2. Therefore, to form the low beam pattern having the cut-off line, the material layer 340 needs to be essentially provided in the second-second section 332-2. In contrast, unlike the configuration illustrated in FIG. 4, according to another example of the present disclosure, the material layer 340 may be provided not only in the second-second section 332-2, but also in the second-first section 332-1.

Meanwhile, as described above, the second section 332 may include the cut-off portion. More specifically, referring to FIGS. 5 and 6, the second-first section 332-1 may have a cut-off portion 333 having a stepped shape. The cut-off portion 333 may be configured to block a part of the light emitted from the light source 100 in order to form a cut-off line for defining an upper boundary of a low beam pattern formed by the lamp 10 according to the present disclosure.

More specifically, the cut-off portion 333 may include an upper surface 333*a* provided at one side based on the leftward/rightward direction, a lower surface 333*b* provided at the other side based on the leftward/rightward direction and disposed below the upper surface 333*a*, and an inclined surface 333*c* configured to connect the upper surface 333*a* and the lower surface 333*b* and extending to be inclined.

Meanwhile, according to the present disclosure, the light entering portion 310 may have a shape symmetric in the upward/downward direction and the leftward/rightward direction. For example, the light entering portion 310 may be an anamorphic lens in which a focal point in the upward/downward direction and a focal point in the horizontal direction are different from each other. However, the shape of the light entering portion 310 is not limited to the above-mentioned shape.

In this case, the light guide body 300 of the lamp 10 according to the present disclosure may satisfy Expression 1 below when a height of the light entering portion 310 in the upward/downward direction is h, a distance from the focal point F1 of the light entering portion 310 to the light entering portion 310 in the leftward/rightward direction is d, and an incident angle of incident light L, which enters the light entering portion 310 and reaches the first section 331, with respect to the first section 331 is θ.

$$\tan(90°-\theta) \geq (h/2d). \qquad \text{Expression 1:}$$

This may be to allow at least a part of the light reaching the first section 331 to be totally reflected in the first section 331.

Meanwhile, according to an example of the present disclosure, a direction in which the second-first section 332-1 extends in the forward/rearward direction may be parallel to an optical axis AO of the light exiting portion 320. In this case, the structure of the light guide body 300 including the light exiting portion 320 and the recessed region 330*a* is simplified, which makes it easy to manufacture the light guide body 300.

On the contrary, according to another example of the present disclosure, the direction in which the second-first section 332-1 extends in the forward/rearward direction may intersect the optical axis AO of the light exiting portion 320 at a predetermined angle. For example, according to another example of the present disclosure, the second-first section 332-1 may be inclined upward in the forward direction with respect to the optical axis AO of the light exiting portion 320. According to another example of the present disclosure, the second-first section 332-1 may be inclined downward in the forward direction with respect to the optical axis AO of the light exiting portion 320. In particular, in the case in which the second-first section 332-1 is inclined downward in the forward direction with respect to the optical axis AO of the light exiting portion 320, it is possible to minimize a situation in which the light beams, which are reflected in the second-first section 332-1 among the light beams entering the light guide body 300, exit the upper surface or the like of the body portion 330 without reaching the light exiting portion 320. Therefore, it is possible to improve the luminous efficiency of the lamp 10.

Meanwhile, as illustrated in FIG. 1, according to the present disclosure, a size of the light entering portion 310 may be larger than a size of the light exiting portion 320. More specifically, a height of the light entering portion 310 in the upward/downward direction may be higher than a height of the light exiting portion 320 in the upward/downward direction. A width of the light entering portion 310 in the leftward/rightward direction may be larger than a width of the light exiting portion 320 in the leftward/rightward direction. This may be to maximize the light concentration efficiency when the light entering the light entering portion 310 exits the light exiting portion 320 to the outside.

Vehicle

A vehicle according to the present disclosure may include the lamp 10 for a vehicle. In this case, the lamp 10 may be a lamp for forming a low beam pattern.

In this case, the lamp 10 may include the light source 100 configured to emit light, and the light guide body 300 provided forward of the light source 100 and configured to allow the light to enter the light guide body 300. The light guide body 300 may be made of a material that transmits the light.

In addition, the light guide body 300 may include the body portion 330 configured to define the body of the light guide body 300. The body portion 330 may include the recessed region 330*a* provided in the lower surface of the body portion 330 and recessed upward.

The recessed region 330*a* may include the first section 331 extending to be inclined upward in the forward direction, and the second section 332 provided forward of the first section 331 and extending forward or downward from the first section 331.

In this case, according to the present disclosure, the material layer 340 may be provided on the surface of the second section 332 and reflect or absorb the light.

Meanwhile, the above-mentioned description of the lamp for a vehicle according to the present disclosure may also be equally applied to the vehicle according to the present disclosure.

The present disclosure has been described with reference to the limited embodiments and the drawings, but the present disclosure is not limited thereto. The present disclosure may be carried out in various forms by those skilled in the art, to which the present disclosure pertains, within the technical spirit of the present disclosure and the scope equivalent to the appended claims.

What is claimed is:

1. A lamp for a vehicle, the lamp comprising:

a light source configured to emit light; and a light guide body provided in front of the light source and configured to allow the light to enter the light guide body, wherein the light guide body is made of a material that transmits the light and the light guide body comprises a body portion comprising a recessed region formed in a lower surface of the body portion and recessed upward, and further comprises a light exiting portion connected to a front side of the body portion, wherein the recessed region comprises:

a first section extending and inclined upward in a forward direction; and a second section provided in front of the first section and extending forward or downward from the first section, wherein a material layer configured to reflect or absorb the light is provided on an outer surface of the second section, and wherein a focal point of the light exiting portion is disposed within a width of the second section in a forward/rearward direction, wherein among light beams that are emitted from the light source and reach the first section, a portion of the light beams are reflected upward from the first section, and remaining light beams transmit through the first section, and wherein the material layer is configured to prevent the remaining light beams transmitted through the first section from propagating forward.

2. The lamp of claim 1, wherein the material layer is provided only in a region between the first section and the second section.

3. The lamp of claim 1, wherein the first section is configured to allow light beams, which reach at least a partial region of the first section, to be totally reflected in the first section.

4. The lamp of claim 1, wherein the first section is configured to allow the light beams, which reach any region of the first section, to be totally reflected in the first section.

5. The lamp of claim 1, wherein the light guide body further comprises a light entering portion connected to a rear side of the body portion, wherein the light entering portion has a shape convexly protruding rearward, and the light exiting portion has a shape convexly protruding forward.

6. The lamp of claim 1, wherein at least a part of the second section is provided in front of the focal point of the light exiting portion.

7. The lamp of claim 1, wherein the focal point of the light exiting portion is spaced apart upwardly from the second section and disposed within a width of the second section in leftward/rightward direction.

8. The lamp of claim 1, wherein the second section comprises:

a second-first section connected to the first section and extending forward from the first section; and a second-second section connected to the second-first section and extending downward from the second-first section, wherein the material layer is provided only in the second-second section of the second section.

9. The lamp of claim 1, wherein the second section comprises:

a second-first section connected to the first section and extending forward from the first section; and a second-second section connected to the second-first section and extending downward from the second-first section, wherein the material layer is provided in each of the second-first section and the second-second section.

10. The lamp of claim 5, wherein the light guide body satisfies Expression 1 when a height of the light entering portion in an upward/downward direction is h, a distance from a focal point of the light entering portion to the light entering portion in a leftward/rightward direction is d, and an angle of incident light, which enters the light entering portion and reaches the first section, with respect to the first section is θ:

Expression 1: $\tan(90° - \theta) \geq (h/2d)$.

11. The lamp of claim 10, wherein the light entering portion has a symmetric shape in the upward/downward direction and the leftward/rightward direction.

12. The lamp of claim 8, wherein a direction in which the second-first section extends in a forward/rearward direction is parallel to an optical axis of the light exiting portion.

13. The lamp of claim 8, wherein a direction in which the second-first section extends in a forward/rearward direction intersects an optical axis of the light exiting portion at a predetermined angle.

14. The lamp of claim 13, wherein the second-first section is inclined upward in the forward direction with respect to the optical axis of the light exiting portion.

15. The lamp of claim 13, wherein the second-first section is inclined downward in the forward direction with respect to the optical axis of the light exiting portion.

16. The lamp of claim 8, wherein the second-first section comprises a cut- off portion having a stepped shape, the cut-off portion comprises:

an upper surface provided at one side based on a leftward/rightward direction;

a lower surface provided at another side based on the leftward/rightward direction and disposed below the upper surface; and an inclined surface configured to connect the upper surface and the lower surface and extending to be inclined.

17. The lamp of claim 1, wherein a height of the light entering portion in an upward/downward direction is greater than a height of the light exiting portion in the upward/downward direction.

18. The lamp of claim 17, wherein a width of the light entering portion in a leftward/rightward direction is larger than a width of the light exiting portion in the leftward/rightward direction.

19. The lamp of claim 1, further comprising:

a collimator provided in front of the light source and configured to allow light emitted from the light source to enter the collimator.

20. A vehicle comprising:

a lamp comprising:

a light source configured to emit light; and a light guide body provided in front of the light source and configured to allow the light to enter the light guide body, wherein the light guide body is made of a material that transmits the light, and the light guide body comprises a body portion comprising a recessed region provided in a lower surface of the body portion and recessed upward, and further comprises a light exiting portion connected to a front side of the body portion, wherein the recessed region comprises:

a first section extending and inclined upward in a forward direction; and a second section provided in front of the first section and extending forward or downward from the first section, wherein a material layer configured to reflect or absorb the light is provided on an outer surface of the second section, and wherein a focal point of the light exiting portion is disposed within a width of the second section in a forward/rearward direction, wherein among light beams that are emitted from the light source and reach the first section, a portion of the light beams are reflected upward from the first section, and remaining light beams transmit through the first section, and wherein the material layer is configured to prevent the remaining light beams transmitted through the first section from propagating forward.

* * * * *